US007839232B2

(12) United States Patent
London

(10) Patent No.: US 7,839,232 B2
(45) Date of Patent: Nov. 23, 2010

(54) BROADBAND TRANSMISSION LINE TRANSFORMER

(75) Inventor: Simon Y. London, Rockville, MD (US)

(73) Assignee: BAE Systems Information and Electronic Systems Integration Inc., Nashua, NH (US)

( * ) Notice: Subject to any disclaimer, the term of this patent is extended or adjusted under 35 U.S.C. 154(b) by 0 days.

(21) Appl. No.: 12/507,836

(22) Filed: Jul. 23, 2009

(65) Prior Publication Data

US 2009/0284323 A1 Nov. 19, 2009

Related U.S. Application Data

(62) Division of application No. 11/224,972, filed on Sep. 14, 2005, now Pat. No. 7,583,160.

(60) Provisional application No. 60/610,692, filed on Sep. 17, 2004.

(51) Int. Cl.
*H01P 5/10* (2006.01)

(52) U.S. Cl. ..... 333/26; 333/33

(58) Field of Classification Search ..... 333/25, 333/26, 33, 35; 336/180, 182, 200
See application file for complete search history.

(56) References Cited

U.S. PATENT DOCUMENTS 4,554,518 A 11/1985 Baer
5,309,120 A 5/1994 Koontz
5,767,754 A 6/1998 Menna
6,018,277 A 1/2000 Vaisanen
6,535,077 B1 * 3/2003 Hiroshima et al. ..... 333/26

FOREIGN PATENT DOCUMENTS

RU 649050 2/1979

OTHER PUBLICATIONS

London, S. et al., "Line Transformers with Fractional Transformer Factor", Telecommunication and Radio Engineering, vol. 238/29, pp. 129-130, Apr. 1974.

* cited by examiner

*Primary Examiner*—Stephen E Jones
(74) *Attorney, Agent, or Firm*—Daniel J. Long

(57) ABSTRACT

A broadband transmission line impedance transformer performs impedance transformation with improved frequency response and efficiency across a wide operational bandwidth. In particular, the bandwidth of a transmission line 2:1 impedance transformer may be significantly increased by adding an additional compensating capacitor as an internal component between interconnected transmission lines. This capacitor effectively improves low frequency response for a given length of transmission lines and decreases mismatch in an entire frequency range. The overall bandwidth ratio increases at least twice and mismatch decreases.

3 Claims, 6 Drawing Sheets

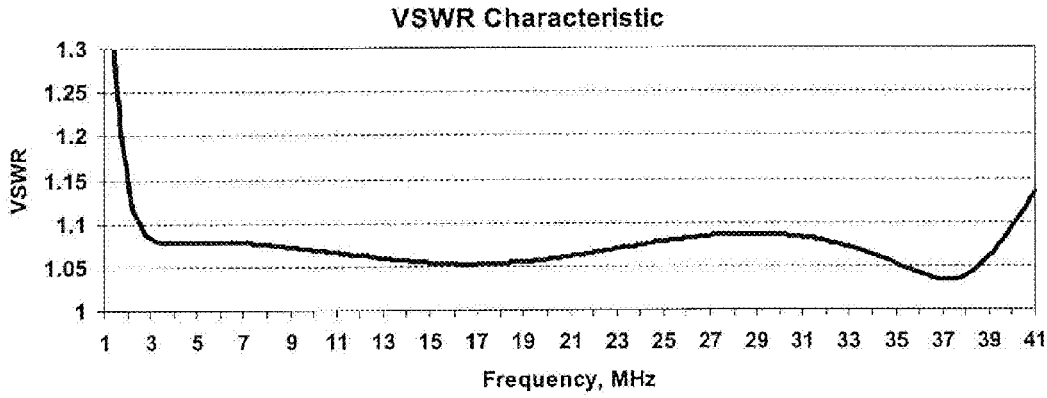
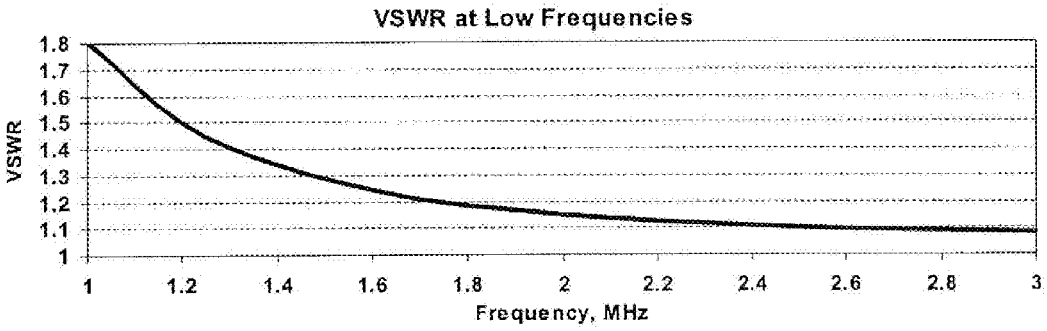
Fig.12 (a,b)
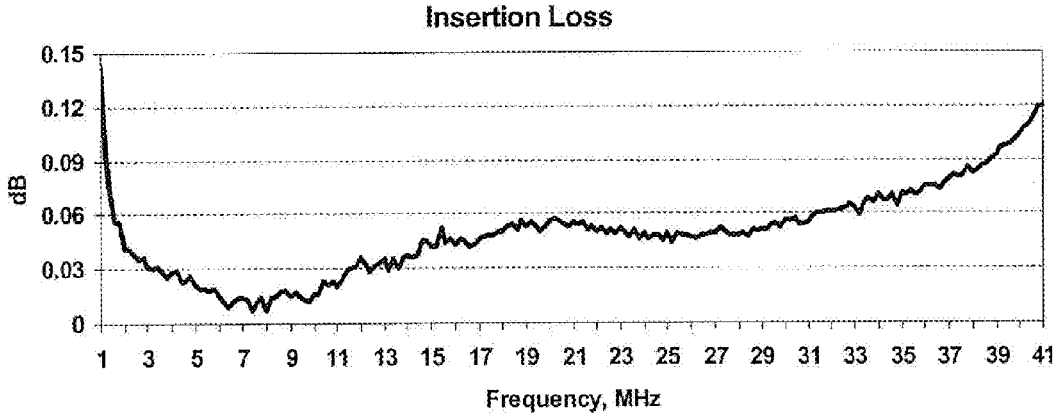
Fig.13

BROADBAND TRANSMISSION LINE TRANSFORMER

CROSS REFERENCE TO RELATED APPLICATIONS

This application is a divisional of Ser. No. 11/224,972 filed Sep. 14, 2005 now U.S. Pat. No. 7,583,160, which claims priority to U.S. Provisional Application No. 60/610,692 filed on Sep. 17, 2004 entitled "Broadband Transmission Line Transformer" by Simon Y. London.

BACKGROUND OF THE INVENTION

1. Field of the Invention

This invention relates generally to broadband radio-frequency impedance transformers. More particularly, the invention relates to broadband transmission line transformers with non-integer turns ratio (fractional ratio transformers) and mostly for high power application.

2. General Description of the Prior Art

A particular class of RF impedance transformers with maximum achievable bandwidth and low insertion losses is a class of transmission line transformers that plays an important role in various RF systems, from low power up to high power levels.

The main frequency limitation factors of these transformers are shunt inductance at lower frequencies and electrical length of transmission lines at higher frequencies. These two contradictory factors determine the achievable bandwidth of transformers. Impedance transformers with diverse circuit models, having different interconnections of transmission lines and impedance transformation ratios, have different limitations influenced by these two factors. As result, greater or lower bandwidth can be achieved.

Widely used impedance transformation ratios are 4:1, 9:1 and 16:1 (integer turns ratios), and 1.5:1, 2:1, 3:1 (fractional turn's ratios). The latter ones are more difficult to realize at wide bandwidths, especially for high power application.

Various circuit diagrams of transmission line impedance transformers are presented in book of Jerry Sevick "Transmission Line Transformers." Among the impedance transformers with non-integer turns ratios, the most necessary is 2:1 impedance transformer. A typical structure includes a two-way power combiner/divider, which consists of a combiner/divider itself and a 2:1 impedance transformer.

All of these RF transformers have multi-octave bandwidth and use generally ferrite toroids or other ferrite configurations. Due to high magnetic permeability of ferrite transformers, shunt inductance is high enough and it is possible to realize multi-octave bandwidth with admissible electrical length of transmission lines.

In high power transformers (5-100 kW), magnetic flux in ferrite is also high and introduces harmonics and intermodulation products.

Furthermore, for these transformers, hysteresis losses (heat dissipation) limiting power handling capability may require a liquid cooling system. Such transformers are heavy, expensive and can not be used in certain environmental conditions.

Many attempts to develop high power, broadband transformers without ferrite have been made. In this case the high-pass correction usually used for partly compensation of relatively small shunt inductance. In simplest case it may be one series connected capacitor at the input or at the output of transformer.

In spite of this, for achieving multi-octave bandwidth, especially at high power, the electrical length of the transformer's transmission lines should be great and high frequency limitation occurs. Additional low-pass correction compensates this effect to some extent. All of these corrections make transformers more complicated and expensive.

In addition, for transformers with fractional turn ratios, the impedance ratios in some practical cases are not close enough to integer numbers and, consequently, even if the transformer is ideal some mismatch occurs. For example, when typical turns ratio is 3/2, the corresponding impedance's ratio is 2.25, and with respect to required impedance transformation ratio equal to the calculated VSWR=1.125. Practically, in this case value of VSWR will be higher.

Furthermore, in combining the power of several amplifiers, a two-or more stage combining system is usually used. If each stage inserts some particular VSWR, the overall VSWR in the worst case is a product of its individual values. To decrease the above-mentioned theoretical value, the turns ratio 7/5 instead of 3/2 may be used, for example. A corresponding transformer is too complicated, especially for high power application. Besides, admissible electrical length of its transmission lines should be relatively small and the highest operating frequency decreases.

The factors discussed above are applicable to impedance transformers that are unbalanced, balanced and baluns (balanced-to-unbalanced). Frequently it is difficult to provide good balance for high power, broadband baluns, especially for fractional turns ratios.

In a prior art balun with 2.25:1 impedance ratio (U.S. Pat. No. 5,767,754), an additional transformer winding is used to improve balance. This winding introduces capacitive shunt effect that increases mismatch. Besides, balance can not be perfect due principally to the asymmetry of circuit models and the influence of stray elements, especially for high power applications. Different longitudinal voltages on the windings also introduce additional difficulties at high power levels.

Another approach is a chain connection of two transformers in different combinations (see books of Jerry Sevick: "Transmission Line Transformers" and "Building and Using Baluns and Ununs," CQ Communications Inc., 1994). This approach is too complicate at high power levels and the balance is not good enough due to stray elements in real design.

In view of the above, it is an object of the present invention to provide a more effective, high power broadband impedance transformer.

It is another object of the present invention to provide a high frequency, high power transformer with unbalanced ports that is simple in construction and has a wide bandwidth without ferrite.

It is still a further object of the present invention to provide an unbalanced impedance transformer without ferrite having a multi-octave bandwidth ratio up to 20:1.

Still another object of the present invention is to provide a high power, broadband unbalanced transformer with a fractional turns ratio, and specifically to provide a 2:1 impedance transformation ratio.

Yet another object of the present invention is to provide a broadband, unbalanced transformer with a simple correction.

It is still a future object of the present invention to provide a broadband, unbalanced impedance transformer having very small mismatch with respect to standard nominal port impedances.

It is another object of the present invention to provide a high frequency, high power transformer with balanced ports that is simple in construction and has wide bandwidth without ferrite.

It is still a future object of the present invention to provide a broadband balanced-to-unbalanced impedance transformer (balun) having all above mentioned properties and good balance in entire frequency band.

SUMMARY OF THE INVENTION

According to the present invention, a significant increase in bandwidth and a simplifying, multi-octave impedance transformer are achieved. These results are obtained by combining two factors in one device:

High admissible electrical length of transmission lines in a simple schematic model; and usage of a correcting capacitor as an internal component between interconnected transmission lines.

This capacitor, together with shunt inductance of transmission lines, effectively decreases mismatch in the entire frequency band caused by 3/2 turn's ratio.

The described effect takes place for unbalanced-to-unbalanced transformers, for balanced-to-balanced transformers and for balanced-to-unbalanced transformers (baluns).

BRIEF DESCRIPTION OF DRAWINGS

The above described features and advantages of the present invention will be more fully appreciated with reference to the detailed description and figures, in which:

FIGS. 12*a,b* illustrate an experimental VSWR characteristic of a two-way power combiner incorporated into a transformer according to an embodiment of the present invention.

FIG. 13 is a graph of experimental insertion loss characteristics a of two-way power combiner incorporated into a transformer according to an embodiment of the present invention.

DETAILED DESCRIPTION

Figure 1:
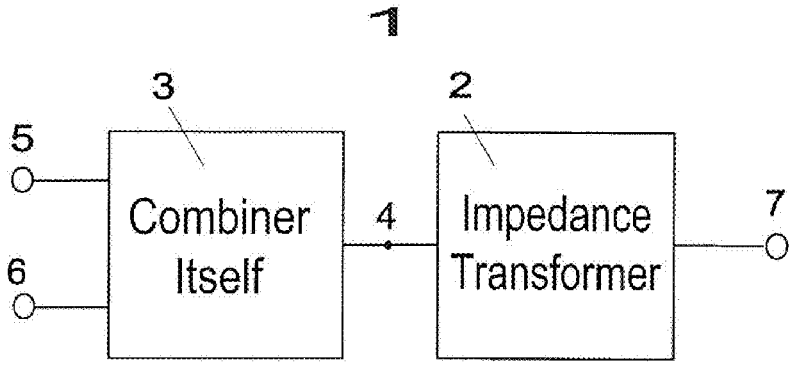
FIG.1 PRIOR ART
FIG. 1 illustrates the block diagram of a typical usage of a broadband impedance transformer having a preferable 2:1 impedance transformation ratio and incorporated with two-way power combiner/divider according to the prior art.

Referring to FIG. 1, there is typical prior art arrangement 1 when a 2:1 impedance ratio transformer 2 is required. Widely used broadband power combiners/dividers 3 have, at common output/input port 4, the parallel connection of two 50-Ohm transmission lines. Inside combiner/divider these lines (or frequently coaxial cables) may be interconnected in various ways, depending on the schematic of the device, but two inputs/outputs 5 and 6 still have nominal 50-Ohm impedance. By a 2:1 impedance ratio transformer 2, the nominal impedance at port 7 will be also 50 Ohm.

At high power and in a broadband application, where efficiency is an important factor, transmission line impedance transformers are the best in most cases of HF-VHF frequency bands. These transformers generally have a simple construction.

Figure 2:
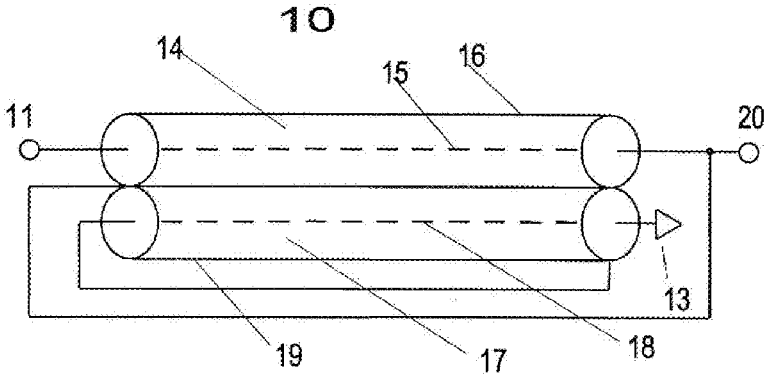
FIG.2 PRIOR ART
FIG. 2 illustrates a 2.25:1 broadband impedance transformer constructed with coaxial cables according to the prior art.

Referring to FIG. 2, there is electrical scheme of one of such transformer 10, investigated in above-mentioned book of Jerry Sevick. This transformer consists of paired coax cables 14 and 17 with their inner conductors 15 and 18 correspondingly. Paired outer conductors 16 and 19 form the second turn of transformer. Conductors 15 and 18 form first and third turns correspondingly.

The nominal impedance at port 11 with respect to common ground 13 is 2.25 times more than the nominal impedance at port 20 with respect to ground 13. Consequently, this unbalanced transformer with fractional 3/2 turns ratio, even if ideal, implies VSWR=1.125. Shunt inductance increases this value at lower frequencies.

Besides, this transformer can operate satisfactorily if electrical length each of its transmission line does not exceed 60 deg at upper operating frequency. Corresponding optimum characteristic impedances of two coax cables 14 and 17 are different and non-standard values. For equal or standard values of characteristic impedances maximum admissible electrical length decreased rapidly.

Figure 3:
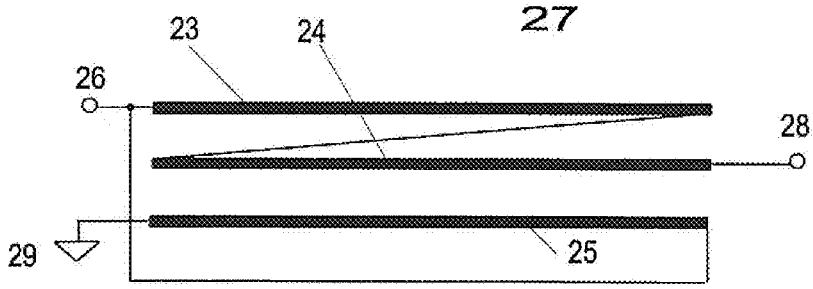
FIG.3 PRIOR ART
FIG. 3 illustrates a 2.25:1 broadband impedance transformer that consists of three-conductor transmission line according to the prior art.

Another electrical scheme of simple impedance transformer with the same impedance transformation ratio 2.25 and near the same achievable frequency characteristics is shown on FIG. 3. The spacing between adjacent conductors 23 and 24, as well as spacing between adjacent conductors 24 and 25 are critical parameters to obtain maximum high frequency response. Two ports 26 and 28 are unbalanced with respect to common ground 29. The main distinction between transformers shown on FIG. 2 and FIG. 3 is a different mutual arrangement of conductors.

Figure 4:
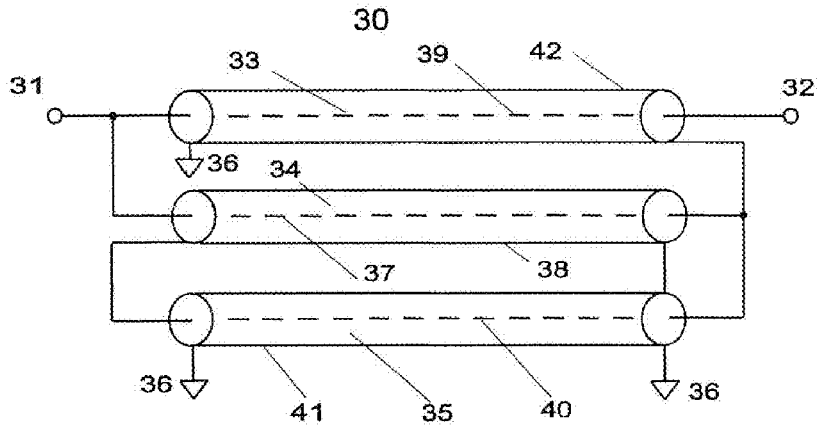
FIG.4 PRIOR ART
FIG. 4 illustrates a 2.25:1 ratio impedance transformer that consists of three matched transmission lines, and specifically coax cables according to the prior art.

Referring to FIG. 4, there is an electrical schematic of another prior art 2.25:1 ratio unbalanced impedance transformer. It consists of three matched transmission lines 33, 34 and 35 having equal characteristic impedances. This transformer is described in the article of S. E. London and S. V. Thomashevich, "Line Transformers with Fractional Transformation Factor," Telecommunication and Radio Engineering, vol. 28/29, April 1974, pp. 129-131 and in the book of Jerry Sevick "Building and Using Baluns and Ununs," CQ Communications Inc., 1994).

Ideally, this transformer with unbalanced ports 31 and 32 with respect to common ground 36 is operable at an unlimited upper frequency. On the other hand, it consists of two separate shunt inductances, formed by outer conductors of lines 33 and 34, and of three separate transmission lines. Implementation of this transformer in high power applications introduces stray inductances and capacitances that decrease the upper operating frequency.

Moreover, at some electrical length, all transmission lines have a resonance cut-off frequency that may occur. As a result, these transformers are relatively complicated and operate also at limited electrical length of transmission lines.

Another prior art transformer (FIG. 5) is obtained from the transformer of FIG. 4 if the length of line 35 equals zero, and if two outer conductors of lines 33 and 34 are connected together at their equi-potential points. These lines can be paired as shown on FIG. 5.

This 2.25:1 ratio impedance transformer with two unbalanced ports 51 and 52 with respect to common ground 53 has the same characteristic impedance of both lines 54 and 57. The line 54 with inner conductor 55 and outer conductor 56 corresponds to line 32 on FIG. 4. The line 57 with inner conductor 58 and outer conductor 59 corresponds to line 36. Line 35 on FIG. 4 is excluded. This transformer has features with respect to the transformers of FIG. 2 and FIG. 3 in mutual arrangement of conductors. This mutual arrangement provides satisfactory operation up to electrical length of each line 105 deg. (as described in the article in "Telecomm. and Radio Eng.", 1974). Besides, the optimum characteristic impedances of lines 54 and 57 are equal and the same as transformer FIG. 4.

Figure 5:
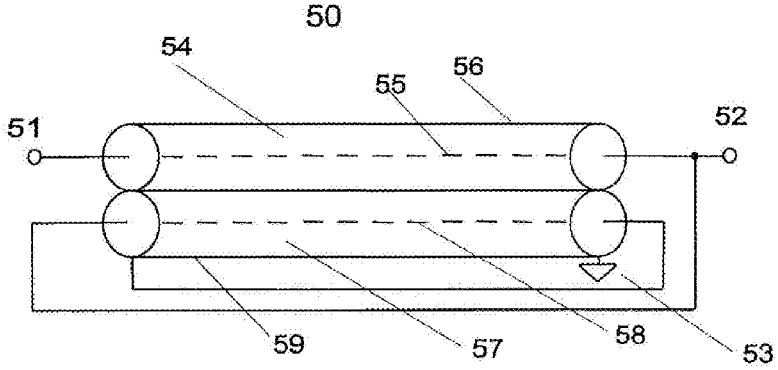
FIG.5 PRIOR ART
FIG. 5 illustrates a 2.25:1 ratio impedance transformer that consists of coaxial cables with identical characteristic impedances according to the prior art.
Figure 6:
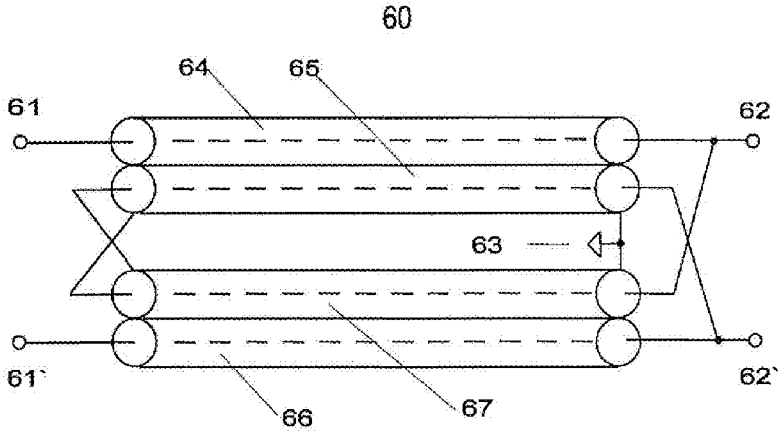
FIG.6 PRIOR ART
FIG. 6 illustrates a 2.25:1 impedance ratio balanced-to-balanced impedance transformer according to the prior art.

Referring to FIG. 6, there is a prior art electrical schematic of a 2.25 ratio balanced to balanced impedance transformer 60, which has practically the same frequency limitations as the transformer shown on FIG. 5. The nominal impedance at balanced port 61-61' is 2.25 times more than the nominal impedance at balanced port 62-62'. This transformer is symmetrical with respect to ground 63. Two paired coax cables 64 and 65 are the same as cables 66 and 67. Characteristic impedances of coax 64 and coax 66 are equal and two times less than characteristic impedances of coax cables 65 and 67.

All transformers shown on FIGS. 2-6 have low frequency limitations due to shunt inductances, which may be partly compensated (included in high-pass filter) by using additional components.

Figure 7:
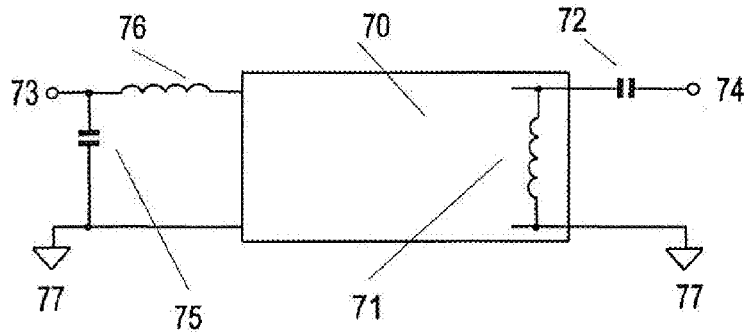
FIG.7 PRIOR ART
FIG. 7 illustrates the block diagram of a broadband impedance transformer with lumped correction elements according to the prior art.

Referring to FIG. 7, there is a prior art block diagram of a broadband impedance transformer 70, having unbalanced ports 73 and 74 with respect to common ground 77. Compensating elements 72, 75 and 76 are connected typically at the input and at the output of transformer 70. Capacitor 72 provides lower frequency correction; it forms high-pass filter with the transformer's shunt inductance 71. Inductance 76 and capacitor 75 provides high frequency correction (see U.S. Pat. No. 5,309,120).

With this three-element correction, the transformers in U.S. Pat. No. 5,309,120 provide bandwidth ratio up to 5:1. They can operate satisfactorily at electrical length of lines significant less than 90 deg.

Figure 8A:
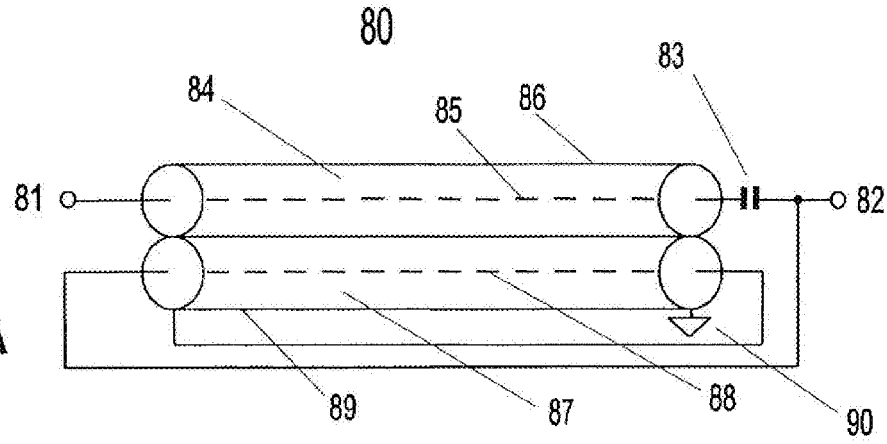
FIG. 8A illustrates 2:1 impedance ratio unbalanced transformer according to an embodiment of the present invention.

Referring now to FIG. 8A, there is an electrical schematic of a 2:1 ratio impedance transformer 80 in accordance with the present invention. In this transformer having two unbalanced ports 81 and 82 with respect to common ground 90, internal capacitor 83 plays two roles:

Effectively compensates shunt inductance of paired outer conductors 86 and 89, and Decreases inserted mismatch due to 3/2 turns ratio in a wide frequency band.

The optimum characteristic impedance of each of the coax cables 84 and 87 is equal $Z_0\sqrt{2}$, where $Z_0$ is nominal impedance at port 82 (lower impedance side).

For transformers with a typical required 50:25 Ohm impedance transformation, the characteristic impedance of each coax, Z=35.35 Ohm, i.e., is practically 35 Ohm. Manufactured coax cable UT 141-35 has Z=35 Ohm.

Capacitor 83 in this transformer is connected between the end of inner conductor 85 of the first line 84 and port 82. On the other hand, this capacitor is connected inside the transformer and between the first turn 85 and the second turn 88. The third turn is formed by connecting together outer conductors 86 and 89 of coax cables 84 and 87.

Capacitor 83, together with the inductance of paired outer conductors 86 and 89, forms a high-pass filter that also improves frequency response. As a result, this transformer has the following advantages:

Simple in construction (includes paired coax that have equal characteristic impedances), Includes only one correcting element, Operates satisfactorily up to electrical length of each coax 110 deg, and Provides low reflection by relatively low shunt inductance.

The calculated value of reflection coefficient is ISImax 0.035 in cases of a 2:1 impedance transformation ratio.

Figure 8B:
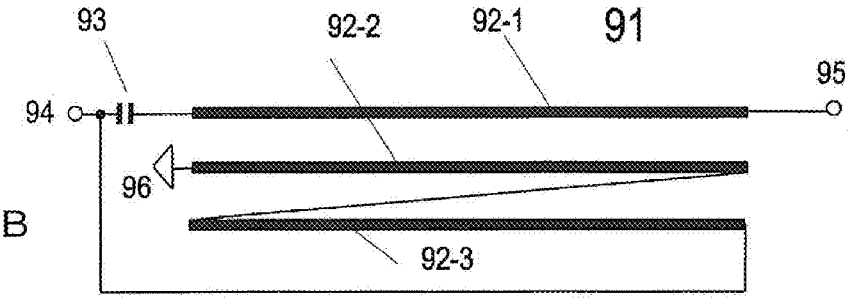
FIG. 8B illustrates the version of FIG. 8A that consists of three-conductor line according to an embodiment of the present invention.

Referring to FIG. 8B, there is an electrical schematic of a 2:1 impedance transformer 91 according to the present invention, which is different from that shown in the FIG. 8A implementation of transmission lines. Instead of paired identical coax, there is a symmetrical three-conductor line with conductors 92-1, 92-2 and 92-3. The capacitor 93 plays the same role as in the transformer, according to FIG. 8A.

Nominal impedances at ports 94 and 95 with respect to common ground 96 are also the same as for FIG. 8A. Therefore, the optimum characteristic impedance of the line formed by adjacent conductors 92-1 and 92-2 is the same as the characteristic impedance of line 84 in FIG. 8A. The optimum characteristic impedance of the line formed by adjacent conductors 92-2 and 92-3 is the same as the characteristic impedance of line 87 on FIG. 8A. In some practical cases this implementation of conductors is preferable for fabrication.

Figure 9A:
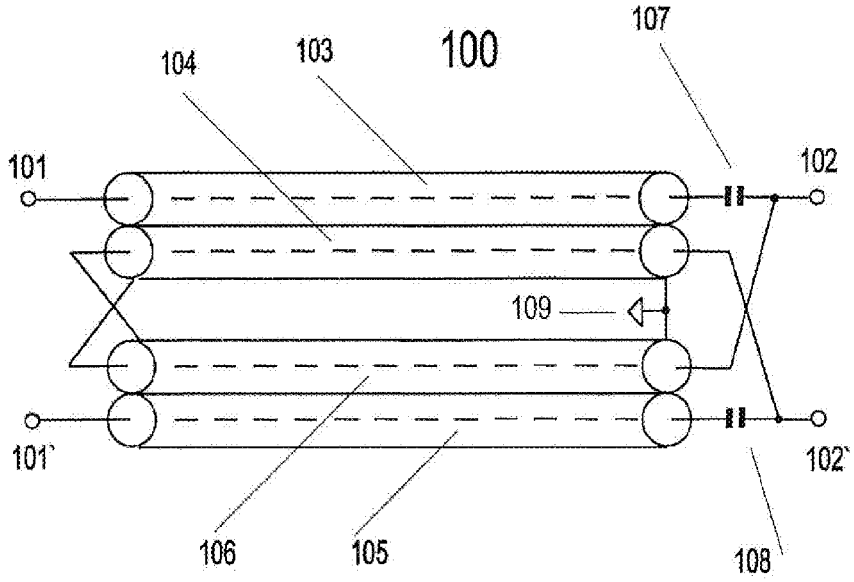
FIG. 9A illustrates 2:1 impedance ratio balanced transformer according to an embodiment of the present invention.

Referring to FIG. 9A, there is an electrical schematic of a balanced-to-balanced 2:1 impedance transformer 100 according to an embodiment of the present invention. The nominal impedance at balanced port 101-101' is twice more than nominal impedance at balanced port 102-102'. This transformer is symmetrical with respect to ground 109. Paired coax cables 103 and 104 have the same characteristic impedances as cables 105 and 106 correspondingly. Characteristic impedances of coax 103 and coax 105 are equal and two times less than characteristic impedances of coax cables 104 and 106.

The optimum characteristic impedance of each coax cable 103 and 105 is equal to Z/42, where Z is the nominal impedance at balanced port 102-102' (lower impedance side). For a transformer with 100:50 Ohm impedance, the transformation characteristic impedance of each coax is equal Z=35.35 Ohm, i.e., practically 35 Ohm.

Two capacitors 107 and 108 have identical values of capacitances. They compensate shunt inductance of two pairs of outer conductors of coax cables 103-104 and 105-106. The calculated reflection coefficient with these capacitors and with relatively small shunt inductance is 0.03 in the case of a 2:1 impedance transformation ratio.

Figure 9B:
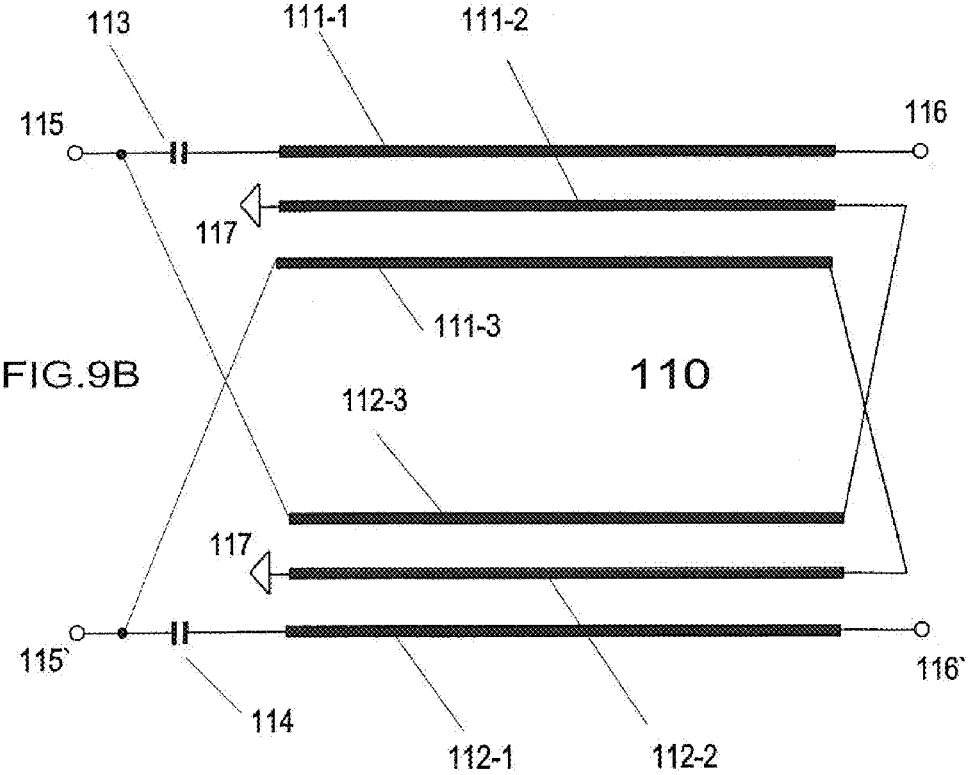
FIG. 9B illustrates the version of FIG. 9A that includes two identical three-conductor lines according to an embodiment of the present invention.

Referring to FIG. 9B, there is an electrical schematic of a 2:1 impedance transformer 110 in accordance with the present invention. This transformer is different from that shown on FIG. 9A implementation of transmission lines. Instead of paired identical coax cables, there are two symmetrical three-conductor lines with conductors 111-1, 111-2, 111-3 and 112-1, 112-2, 112-3 correspondingly. The capacitors 113 and 114 play the same role as capacitors 107 and 108 in the transformer, according to FIG. 9A. Nominal impedances at balanced ports 115-115' and 116116' with respect to common ground 117 are also the same as for transformer shown on FIG. 9A.

Figure 10:
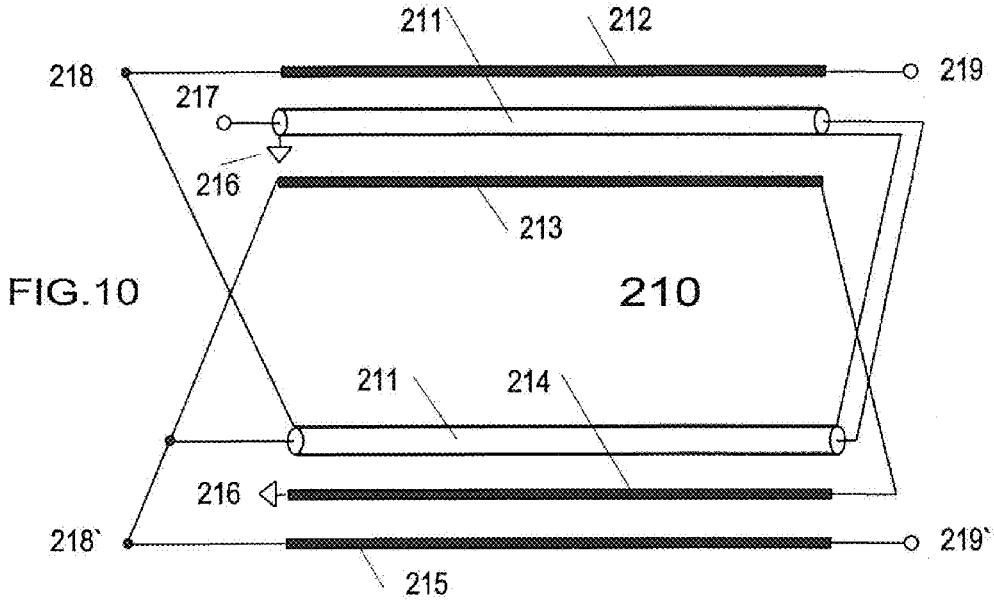
FIG. 10 illustrates a balun transformer according to an embodiment of the present invention.

Now referring to FIG. 10, there is an electrical schematic of a 2.25:1 impedance ratio balun 210 according to an embodiment of the present invention. It consists of coax 211 that plays two roles. Its outer conductor (external surface) and conductors 212, 213, 214 and 215 form a balanced transformer with ports 218-218' and 219-219'. The inner conductor and internal surface of the outer conductor (normally coax cable function) provide a balanced-to-unbalanced transition and form an unbalanced port 217. This impedance transforming balun may be considered a result of an internal chain connection of simplest 1:1 balun and balanced-to-balanced impedance transformer (see S. London and S. Thomachevich, Pat. USSR, no 649050, 1979). Due to this internal chain connection of two transformers, the overall design is simpler than direct chain connection, and balance is better. These two factors are especially important for high power applications. The mutual arrangement of conductors in scheme FIG. 10 is different with respect to that used in a balun according to Pat. USSR no. 649050.

Figure 11:
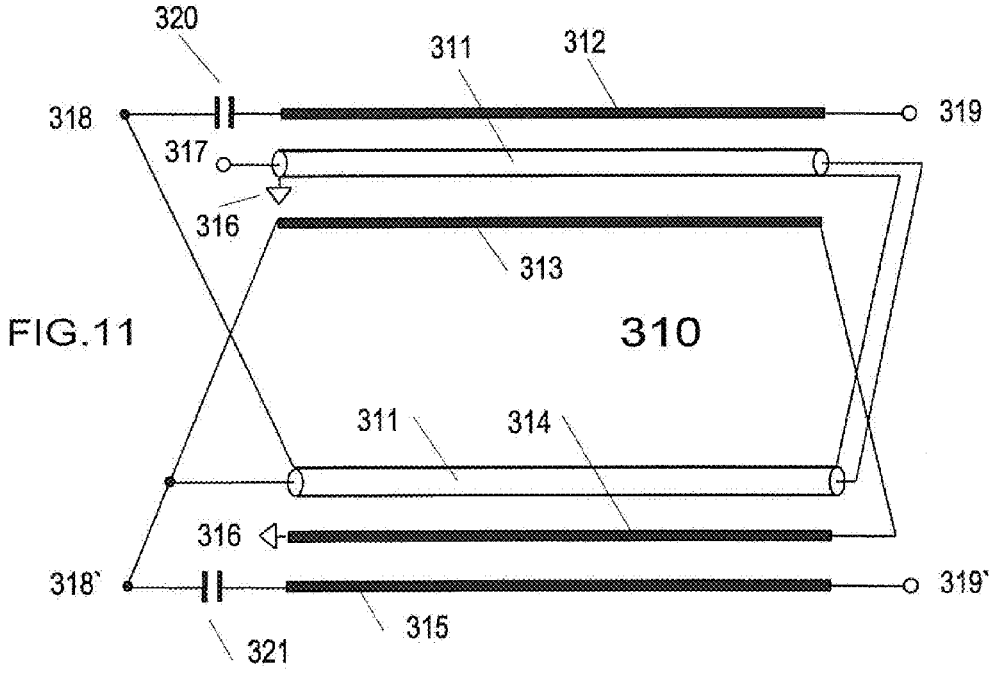
FIG. 11 illustrates a balun transformer with correcting capacitors according to an embodiment of the present invention.

Now referring to FIG. 11, there is an electrical schematic of a 2:1 impedance ratio transformer 310 accordance to an embodiment of the present invention. Coax cable 311 and conductors 312, 313, 314 and 315 operate exactly as coax cable 211 and conductors 212-215 in a balun transformer of FIG. 10 correspondingly. Only additional capacitors 320 and 321 introduce the difference with respect to the balun transformer of FIG. 10. These two capacitors operate exactly as in balanced transformer shown on FIG. 9B, and electrical characteristics are the same as for the balanced transformers of FIG. 9A and FIG. 9B.

Experimental 20:1 Bandwidth Ratio Transformer

The laboratory prototype of an 50:25 Ohm impedance transformer was constructed without ferrite in accordance to FIG. 9A of present invention. It has been incorporated with two-way power combiner/divider as shown on FIG. 1, because it is the main application of such transformer. Besides, it verifies the possibility of designing a full device. Each of paired coax 84 and 87 on FIG. 8 was produced from standard high power 50-Ohm coax FE 81 (15 kW @ f=−500 MHz). To obtain a characteristic impedance equal 35 Ohm, three upper layers of PTFE tape were removed. The transformer consists of three turns of paired these coax cable with average diameter 13.5 cm. Capacitor 83 shown on FIG. 8 is formed as a parallel connection of six standard capacitors HEC HT-50 of 700 pF each.

A two-way power combiner consists of two cables FE 81 connected in parallel at common port 4 (FIG. 1) that gives nominal impedance 25 Ohm this port. Experimental graphs are shown on FIG. 10 and FIG. 11. As we can see on FIG. 12, the obtained $VSWR_{max}$ in an operating frequency band from 2 to 40 MHz is close to a calculated value $VSWR_{max}=(1+(S|max)/(1-|S|max)=1.074$, when $|S| \ldots_x$ is equal ≈0.035, as pointed above.

The calculated upper operating frequency is equal z-, 43.5 MHz, i.e. enough close to an experimental result for a full device (transformer with combiner itself). Data on FIG. 13 showing that full insertion losses of transformer and combiner are low verifies the practical importance of embodiments of the present invention.

While the devices and methods of this invention have been described in terms of specific embodiments, it will be apparent to those of skill in the art that variations may be applied to the devices without departing from the concept, spirit, and scope of the invention. Therefore, all such substitutions and modifications apparent to those skilled in the art are deemed to be within the spirit, scope, and concept of the invention as defined by the appended claims.

What is claimed is:

1. A transformer having enhanced frequency response, comprising:

a balun transformer comprised of a pair of interconnected four conductor transmission lines, said balun transformer having an input port and a balanced output port; and two compensating capacitors coupled inside the balanced part of the transformer;

wherein the compensating capacitor improves low frequency response and decreases mismatch in an entire frequency range.

2. The transformer according to claim 1, wherein the input port is unbalanced.

3. The transformer according to claim 1, wherein the balun transformer includes a connection to ground.

* * * * *